United States Patent [19]

Matsuda et al.

[11] Patent Number: 4,640,245

[45] Date of Patent: Feb. 3, 1987

[54] METHOD OF CONTROLLING AN ENGINE MOUNTED ON A CONSTRUCTION VEHICLE

[75] Inventors: Yukinobu Matsuda, Komatsu; Takayasu Inui, Hirakata, both of Japan

[73] Assignee: Kabushiki Kaisha Komatsu Seisakusho, Tokyo, Japan

[21] Appl. No.: 738,332

[22] Filed: May 28, 1985

[30] Foreign Application Priority Data

May 31, 1984 [JP] Japan ..... 59-109378

[51] Int. Cl.[4] ..... F02D 41/00

[52] U.S. Cl. ..... 123/339; 123/395; 123/399; 123/401; 180/69.3

[58] Field of Search ..... 123/339, 340, 395, 399, 123/400, 401, 319; 180/69.3

[56] References Cited

U.S. PATENT DOCUMENTS

| | | | |
|---|---|---|---|
| 3,982,508 | 9/1976 | Norlin et al. | 123/97 |
| 4,124,095 | 11/1978 | Ezure | 180/69.3 |
| 4,479,472 | 10/1984 | Shimamura | 123/401 |
| 4,545,449 | 10/1985 | Fujiwara | 123/339 |

FOREIGN PATENT DOCUMENTS 3134068 3/1983 Fed. Rep. of Germany .

*Primary Examiner*—Andrew M. Dolinar
*Attorney, Agent, or Firm*—Armstrong, Nikaido, Marmelstein & Kubovcik

[57] ABSTRACT

A method of controlling an engine mounted on a construction vehicle comprising the steps of reducing the rotation of the engine to a primary number of revolutions per minute, which is in the vicinity of the rated number of revolutions per minute of the engine under earth moving operation conditions, immediately after all operating levers associated with all of the control valves for turning the vehicle body, for actuating work implements and for running of the vehicle are shifted to their neutral positions, maintaining the engine under such a low speed running condition for a predetermined period of time, and then reducing further the rotation of the engine to a lower, secondary number of revolutions per minute which corresponds to the number of revolutions per minute under idle running conditions thereby achieving reduction in fuel consumption and level of noise generated by the engine.

4 Claims, 2 Drawing Figures

METHOD OF CONTROLLING AN ENGINE MOUNTED ON A CONSTRUCTION VEHICLE

BACKGROUND OF THE INVENTION

1. Field of the Invention

This invention relates to a method of controlling an internal combustion engine mounted on a construction vehicle which can be driven with less fuel consumption and with lower noise level generated by the engine.

2. Description of the Prior Art

In a construction vehicle having an internal combustion engine (referred to simply as "engine" hereinbelow), variable displacement hydraulic pumps driven by the engine to actuate work implements, and means for controlling the flow rate of the fluid delivered by the hydraulic pumps, the arrangement is made such that one of the following three methods has so far been employed when the output fluid flow from the hydraulic pumps is not required for the vehicle.

1. The engine is not controlled; that is, the number of revolutions of the engine is kept at nearly the same level as that when the output fluid flow from the hydraulic pumps is needed.
2. The amount of fuel injected into the engine is controlled immediately to reduce the number of revolutions of the engine.
3. When a predetermined period of time has passed from the time when the output fluid flow from the hydraulic pumps becomes unnecessary, the amount of fuel injected into the engine is controlled to reduce the number of revolutions of the engine.

Each of the above-mentioned methods has respective disadvantage as mentioned below.

Stating in brief, in the case of the first controlling method, the engine is driven at a high speed even when the output fluid flow from the hydraulic pumps is not required so that the fuel is wasted, and the noise level generated by the engine is high.

While, the second controlling method is suitable for the time of completion of the earth moving operation by the construction vehicle. However, in this method, when earth moving operation is made continuously and intermittent supply of the output fluid flow from the hydraulic pumps is required, frequent changes in the rotating speed of the engine occur thus not only having an adverse effect on the engine, but also giving the driver an unpleasant feeling due to changes in the noise level generated by the engine. Further, the forces produced by the hydraulic pumps will cause a surging phenomenon which results in deterioration of component parts.

In the case of the third controlling method, the number of revolutions of the engine is not reduced until a predetermined period of time passes after the output fluid flow from the hydraulic pumps becomes unnecessary. Therefore, the number of revolutions of the engine is initially kept at a value higher than that at the time of normal operation by an amount corresponding to the reduction in the load on the engine so that fuel is wasted and the noise level generated by the engine becomes higher. Further, since, after the lapse of a predetermined time, the number of revolutions of the engine is reduced from a high speed to a low speed, there is a fear that undesirable low speed rotation occurs. Further, in the case where earth moving operation is made which requires intermittent supply of output fluid flow from the hydraulic pumps in the period of time exceeding the above-mentioned predetermined time, a length of time is required to change from a low speed rotation to a desired high speed rotation, thus causing poorer operability and a lowering in operational efficiency.

SUMMARY OF THE INVENTION

The present invention has been contemplated and devised in view of the above-mentioned circumstances in the prior art, and has for its object to provide a method of controlling an engine mounted on a construction vehicle including the steps of reducing the rotation of the engine to a low speed condition near the rated number of revolutions of the engine under earth moving operation immediately after all the operating levers are shifted to their respective neutral positions, maintaining the engine under such a low speed running condition for a predetermined period of time, and then reducing further the rotation of the engine to a desired low speed (idling speed) condition thereby reducing the fuel consumption and the level of noise generated by the engine.

To achieve the above-mentioned object, according to the present invention, there is provided a method of controlling an engine mounted on a construction vehicle, characterized by that when all the operating levers of work implements and operation systems are located at their neutral positions the number of revolutions of the engine is reduced immediately to a primary lower number of revolutions, maintained at this number of revolutions for a predetermined time, and then reduced to a further lower, secondary number of revolutions.

The above and many other advantages, features and additional objects of the present invention will become apparent to those versed in the art upon making reference to the following detailed description and accompanying drawings in which preferred structural embodiments incorporating the principles of the present invention are shown by way of illustrative example.

DETAILED DESCRIPTION OF THE INVENTION

The method of controlling an engine according to the present invention will be described in detail below with reference to the accompanying drawings.

Figure 1:
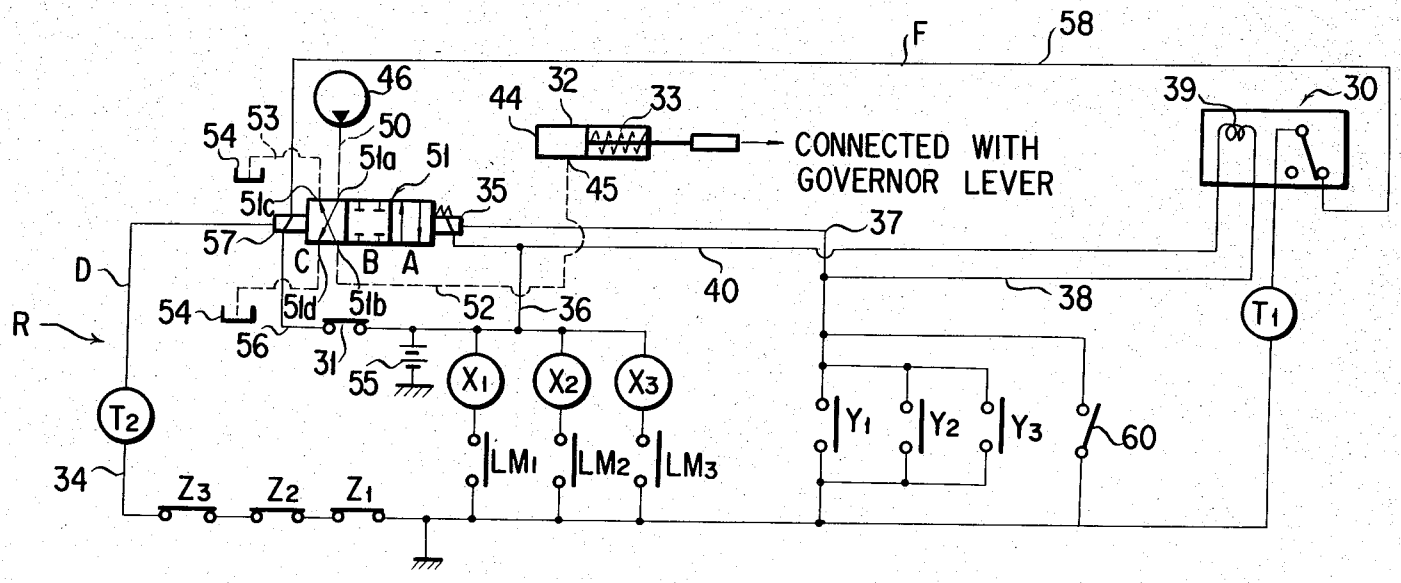
FIG. 1 is a schematic configuration explanatory view showing one embodiment of control system for carrying out a method of controlling an engine mounted on a construction vehicle according to the present invention.

In FIG. 1, reference numeral 32 denotes a decelerator hydraulic cylinder which is adapted to bias a governor control lever, not shown, by the biasing force of a spring 33 in the decelerating direction and to urge the control lever by a fluid pressure in the direction of full rotation.

Reference numeral 46 denotes a fixed displacement hydraulic pump exclusively used for control, the delivery side of which is connected by way of a conduit 50 to an inlet port 51*a* of a solenoid valve 51. The solenoid valve 51 has an outlet port 51*b* which is connected by means of a conduit 52 to a port 45 of the deceleration hydraulic cylinder 32, and a tank port 51*c* which is connected by way of a conduit 53 to a fluid reservoir 54. A drain port 51*d* of the deceleration hydraulic cylinder 32 leads to the reservoir 54.

Referring to the electric circuit R of the solenoid valve 51, as shown in FIG. 1, the anode of a power supply 55 which is a battery is connected by a lead wire 56 through a first auto-deceleration release switch 31 with one terminal of a solenoid 57 of the solenoid valve 51, and another terminal of the solenoid 57 is connected by a lead wire 58 through a switch 30, a first timer $T_1$ and a second auto-deceleration release switch 60 to the earth. Further, a relay for turning $X_1$ and a hydraulic pressure switch $LM_1$ for turning are connected in series with the power supply 55, and further, a relay $X_2$ for actuating work implements and a hydraulic pressure switch $LM_2$ for actuating work implements are connected in series with the power supply 55. Furthermore, a relay $X_3$ for running and a limit switch $LM_3$ for running are connected in series with the power supply 55. Further, on the earthed side of the first timer $T_1$, a normally open contact $Y_1$ of the relay $X_1$ for turning, a normally open contact $Y_2$ of the relay $X_2$ for actuating work implements, and a normally open contact $Y_3$ of the relay $X_3$ for running are connected in parallel with the second auto-deceleration release switch 60.

The first timer $T_1$ is set to be actuated for a predetermined time period, for example, 0.2 to 0.4 seconds. Further, the arrangement is made such that when the operating levers (not shown) of the operating levers (not shown) for turning, running and for actuating work implements are located at their neutral positions, the switches $LM_1$, $LM_2$ and $LM_3$ connected, respectively, with the operating levers are rendered off, whilst when each of the operating levers is located in other positions than the neutral position, switches $LM_1$, $LM_2$ and $LM_3$ are rendered on.

The terminal of the solenoid 57 is connected to the earth by the lead wire 34 through the second timer $T_2$, a normally closed contact $Z_3$ of the relay $X_3$ for running, a normally closed contact $Z_2$ of the relay $X_2$ for actuating work implements, and a normally closed contact $Z_1$ of the relay $X_1$ for turning.

One terminal of another solenoid 35 of the solenoid valve 51 is connected by way of a lead wire 36 to the power supply 55, and another terminal of the solenoid 35 is connected to the earth by a lead wire 37 through normally open contacts $Y_1$, $Y_2$, $Y_3$ and the auto-deceleration release switch 60 which are connected in parallel. Further, another terminal of the solenoid 35 is connected by way of a lead wire 38 with one terminal of a solenoid 39 of the switch 30, and another terminal of the solenoid 39 is connected by way of a lead wire 40 with the power supply 55.

Figure 2:
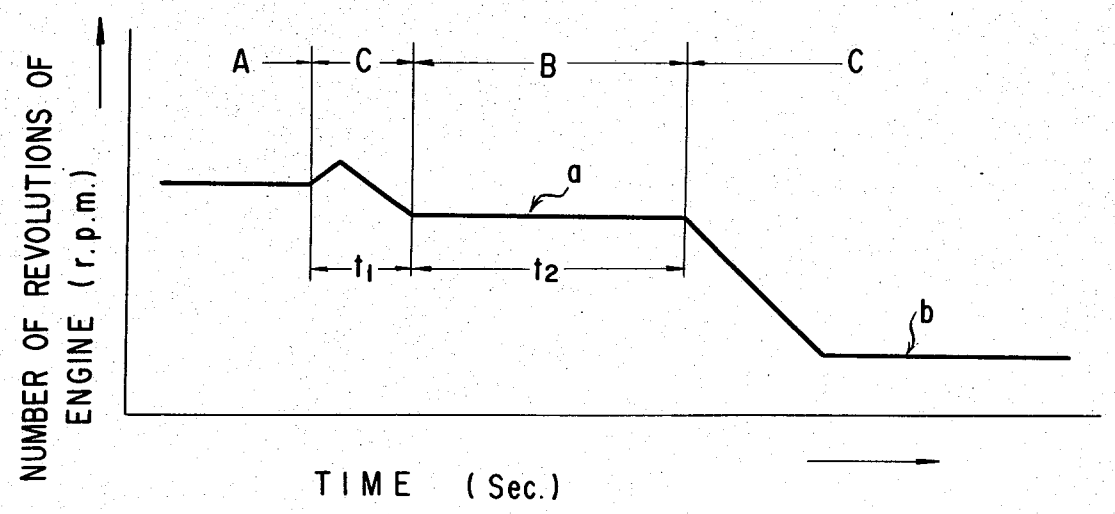
FIG. 2 is a diagram showing the engine control characteristic of a construction vehicle controlled by the method of controlling an engine according to the present invention.

When the engine is rotating, if all the operating levers are returned to their neutral positions, the switches $LM_1$, $LM_2$ and $LM_3$ are turned off so as to turn off the relay $X_1$ for turning, the relay $X_2$ for actuating work implements and the relay $X_3$ for running. For this reason, even when normally open contacts $Y_1$, $Y_2$ and $Y_3$ of the relays $X_1$, $X_2$ and $X_3$ are electrically cut off or broken, the solenoid 57 of the solenoid valve 51 is supplied with an electric current for the time period of about 0.2 to 0.4 seconds preset by the first timer $T_1$. During this period of time, however, the second auto-deceleration release switch 60 is closed. As a result, the solenoid valve 51 is switched from its communicating position A over to its draining position C. (Refer to FIG. 2) in consequence, the fluid under pressure within the head side chamber 44 of the deceleration hydraulic cylinder 32 is allowed to flow into the fluid reservoir 54 so that the piston 34 may be moved back by the resilient force of the spring 33 mounted movably in the deceleration cylinder 32 thereby allowing the governor control lever, not shown, to be returned to its decelerating position.

After the time $t_1$ preset by the timer $T_1$ has passed, if and when the solenoid 57 is deenergized, then the solenoid valve 51 is changed over to its neutral position B.

In the circuit designated with reference character D, normally closed contacts $Z_1$, $Z_2$ and $Z_3$ are electrically connected when the relays $X_1$, $X_2$ and $X_3$ are disconnected. Therefore, the solenoid 57 will be energized by way of the circuit D. However, since the second timer $T_2$ is actuated or rendered on, the energization of the solenoid 57 is delayed by a time period of about 3 to 4 seconds preset by the second timer $T_2$. As a result, the circuit F which has been energized is deenergized, (or controlled by the relays $X_1$, $X_2$, $X_3$ and the first timer $T_1$), and then the aforementioned circuit D is energized so that the solenoid valve 51 may be changed from its neutral position B to its draining position C. (Refer to FIG. 2.)

During the period of time $t_2$ preset by the second timer $T_2$, the position of the solenoid valve 51 is set at its neutral position B and the head side chamber 44 of the deceleration hydraulic cylinder 32 is closed. As a result, the rotational speed of the engine is lowered to a primary number of revolutions per minute "a" which is in the vicinity of the rated number of revolutions under earth moving operation conditions and which is a level that changes in the number of revolutions of the engine have no influence on the operation. The engine is kept running at such number of revolutions for the predetermined time period, i.e., $t_2$ set by the second timer $t_2$, and thereafter the position of the solenoid valve 51 is changed over to its draining position C. As a result, the pressurized fluid within the head side chamber 44 of the deceleration hydraulic cylinder 32 is allowed to flow into the fluid reservoir 51 so that the rotation of the engine may be reduced further to a secondary number of revolutions per minute "b" (idle running) which is lower than the primary number of revolutions.

As mentioned hereinabove, according to the present invention, the arrangement is made such that when all the operating levers are shifted to their neutral positions, the rotation of the engine is reduced immediately, without any time lag, to a primary number of revolutions "a" (which is in the vicinity of the rated number of revolutions under earth moving operation conditions and which is set at such a level that changes in the number of revolutions of the engine have no influence on the earth moving operation), such number of revolutions being maintained for a predetermined period of time, and then the rotation of the engine is reduced further to a secondary number of revolutions "b", i.e., that at idle running condition which is lower than the primary number of revolutions. Therefore, the fuel consumption and the level of noise generated by the engine can be reduced significantly.

It is to be understood that the foregoing description is merely illustrative of the preferred embodiment of the present invention and that the scope of the invention is not to be limited thereto, but is to be determined by the appended claims. Additional modifications or alterations of the invention can be readily made by those skilled in the art without departing from the scope of the invention defined in the claims.

What we claim is:

1. The method of controlling an engine mounted on a construction vehicle used for earth moving operations and including operating levers associated with control valves for work implements and a control system, said operating levers having operating positions and neutral positions, said method comprising the steps of:

reducing the rotational speed of the engine to a primary number of revolutions per minute immediately after all said operating levers associated with all control valves for work implements and the control system are shifted to their respective neutral positions;

maintaining the engine under such a low speed running condition for a predetermined period of time; and then reducing further the rotational speed of the engine to a lower, secondary number of revolutions per minute.

2. The method of controlling an engine mounted on a construction vehicle as claimed in claim 1, wherein said primary number of revolutions per minute is in the vicinity of the rated number of revolutions per minute of the engine under earth moving operation conditions and is at such a level that change in the rotational speed of the engine has no influence on the earth moving operation.

3. The method of controlling an engine mounted on a construction vehicle as claimed in claim 1, wherein said secondary number of revolutions per minute is the number of revolutions per minute of the engine under idle running condition.

4. The method of controlling an engine mounted on a construction vehicle as claimed in claim 1, wherein the duration of said primary number of revolutions is in the range of three to four seconds.

* * * * *